US005237936A

United States Patent [19]

Susel et al.

[11] Patent Number: 5,237,936

[45] Date of Patent: Aug. 24, 1993

[54] PALLET AND DISPLAY ASSEMBLY

[75] Inventors: Christopher J. M. Susel, Ajax; John Manley, Markham, both of Canada

[73] Assignee: So-Green Corp., Markham, Canada

[21] Appl. No.: 872,838

[22] Filed: Apr. 23, 1992

[30] Foreign Application Priority Data

May 3, 1991 [CA] Canada ..... 2041758

[51] Int. Cl.[5] ..... B65D 19/38

[52] U.S. Cl. ..... 108/52.1; 108/51.1

[58] Field of Search ..... 108/51.1, 55.3, 53.5, 108/52.1, 56.3

[56] References Cited

U.S. PATENT DOCUMENTS 2,463,587 3/1949 Arthur ..... 108/51.1

2,890,849 6/1959 Fogarty ..... 108/51.1

*Primary Examiner*—James R. Brittain

*Assistant Examiner*—Gerald A. Anderson

*Attorney, Agent, or Firm*—Smith, Lyons, Torrance, Stevenson & Mayer

[57] ABSTRACT

A pallet having a front, a back and two sides; each of said sides having a fork entry opening, open at both ends of the pallet and along the length of each side; each opening having a stepped upper surface comprising a lower portion for engagement by an upper surface of a fork to lift the pallet and an outer upper portion extending from the inner portion to the side spaced upwardly from the inner portion. The pallet can be used with pallet trucks that have a wider inter-fork distance wider than the width of the pallet to permit adjacent intimate abuttment of similar pallets in a series to provide maximum use of shop floor space and pallet platform stocking area.

6 Claims, 3 Drawing Sheets

PALLET AND DISPLAY ASSEMBLY

FIELD OF THE INVENTION

This invention relates to pallets and more particularly to pallets provided with a goods display arrangement.

BACKGROUND OF THE INVENTION

Pallets, generally formed of wood, are used in the transportation and storage of packaged goods contained in individual containers, such as boxes, cartons, sacks, bags and the like of various sizes. The boxes are stacked in a pallet size load on the pallet and generally retained thereon by retaining means such as wire, rope, thermoplastic or tarpaulin sheets. The loaded pallet is generally then raised by a pallet truck and transported to a truck or railcar for transporation to its destination.

The loaded pallet, generally, ultimately ends up at a retailer of the packaged goods, where the individual containers are generally unloaded from the pallet for display on countershelves or the shop floor. This unloading generally requires individual handling of each or a small number of the containers for restacking on the shelves or floor. Occasionally, the loaded pallet may be used as delivered as a temporary base for the containers in a warehouse or retail establishment until the boxes are individually removed therefrom for stacking elsewhere or sold.

The pallet truck used to raise, lower and transport the pallet is generally a single operator, electrically driven vehicle having a pair of fixed forks which engage the pallet by slipping between the support members of the pallet.

Unlike the more powerful larger fork-lift trucks, pallet trucks generally are not adapted to provide convenient interchangeable and variable inter-fork distances to enable various pallets of different sizes to be readily adapted to be raised. In North America, the width of each individual fork and the inter-fork distance of a pallet truck are either generally standard or are custom made.

A significant economic factor which adds to the cost of handling of goods in pallet form is the eventual manual unloading of the individual cartons, boxes and the like for subsequent stacking for display in those environments where a display arrangement of a plurality of the cartons is desired. This manual manipulation of individual boxes is more pronounced and more wasteful of time, effort and money when several pallet loads of goods are desired to be displayed together in an arrangement for either ready access by the customers and/or for advertisement purposes.

This problem can be alleviated, somewhat, if the dimensions of the boxes, cartons and the like are such as to permit a full loading of the individual boxes on the pallet utilizing the maximum area of the pallet load area, and if the individual pallets are of a sufficiently large size to permit the forks of the standard pallet truck to engage the pallet in the normal manner, such that a plurality of loaded pallets can adjacently intimately, abut one another. This arrangement should cause no loss of shop floor area.

However, in those instances where pallets of a normal standard size, for example, 1 m wide by 1.2 m deep, are not desired, such that transportation and disposition of the loaded pallet by the standard pallet truck cannot provide the intimate abutting relationship of adjacent loaded pallets, valuable shop floor area is lost.

In the very competitive world of retailing, the maximum shop floor area available for goods storage and advertising is sought. Thus, heretobefore, in order to achieve this goal with containers of atypical sizes, manual unloading of the pallets has been necessary.

It is an object of the present invention to provide a pallet for use with a standard pallet truck which permits two or more pallets to adjacently, intimately abut one another to allow maximum use of floor space.

It is a further object of the invention to provide a combined pallet and goods display assembly which can be provided already assembled to a retailer.

SUMMARY OF THE INVENTION

Accordingly, the invention provides in its broadest aspect a pallet having a front, a back and two sides; each of said sides having a fork entry opening, open at both ends of the pallet and along the length of each side; each opening having a stepped upper surface comprising a lower portion for engagement by an upper surface of a fork to lift the pallet and an outer upper portion extending from the inner portion to the side and spaced upwardly from the inner portion.

In a further aspect, the invention provides a pallet for use with a plurality of containers to be stacked thereupon and operably raisable, transportable and lowerable by a pallet truck having a first fork and a second fork separated by an inter-fork distance; said pallet comprising:

a platform upon which said containers are operably stacked, said platform having a first edge and a second edge parallel thereto and separated by a platform width therefrom;

a first fork engaging means below said platform adjacent to, but distant from, said first edge and operably engageable with said first fork;

a second fork engaging means below said platform adjacent to, but distant from, said second edge and operably engageable with said second fork;

wherein said inter-fork distance is greater than said platform width, such that a portion of said first and second forks operably extend beyond said first and said second edges of said platform and wherein said forks do not operably engage said platform.

The term "containers" includes boxes, cartons, bags, sacks and the like of regular or irregular size or shape. In addition to stating the name and/or description of the goods or wares contained in the boxes, sacks and the like, such containers preferably display additionally information such as advertisements and the like for the information of customers and/or to appeal thereto.

By the term "inter-fork distance" is meant the distance between the outer lengthwise edges of the first and second forks. Thus, the first and second edges of the platform are parallel to each other and, operably, to the longitudinal length of the first and second forks when the forks operably engage the pallet. In the engaging operation, because the inter-fork distance is greater than the platform width each of the forks overlap the respective platform edges.

In a preferred aspect the invention provides a pallet for use in storing thereon a plurality of containers and operably raisable, transportable and lowerable by a pallet truck having a first fork and a second fork; said pallet comprising:

a rectangular platform having a first edge and a second edge parallel thereto;

a first fork engaging means operably engageable with said first fork and comprising a first rectangular fork engaging member disposed below and abutted to said platform, and adjacent to but distant from said first edge to provide said platform adjacent said edge with a first fork non-engageable portion such that when said first fork is operably engaged with said first rectangular fork engaging member said first fork non-engageable portion does not engage said first fork;

a second fork engaging means operably engageable with said second fork and comprising a second rectangular fork engaging member disposed below and abutted to said platform, and adjacent to but distant from said second edge to provide said platform adjacent said edge with a second fork non-engageable portion such that when said first fork is operably engaged with said first rectangular fork engaging member said first fork non-engageable portion does not engage said first fork;

a base; and support means disposed between said platform and said base.

The pallet according to the invention may be formed of any suitable material, such as aluminum or a rigid plastics material, but most preferably it is formed of wood in the form of suitably shaped planks, stringers, spars, blocks and the like as is used in conventional pallets. For example, the platform is formed, as in a conventional pallet, of a plurality of wooden planks having an appropriate supporting thickness of generally 2.5–5.0 cm., laid in a side-by-side manner in close proximity. The platform may be of a rectangular shape, which includes square-shaped.

Preferably, the first and second fork engaging means are constituted as an integrally formed rectangular member, which may abut the platform, directly, or through intervening members. It may also be integrally formed with the platform and in such a case the platform could be of a suitable shape of having appropriately-sized lower notch "cut-away" portions adjacent each of said first and second edges. This prevents the forks of the pallet truck from operably engaging these fork non-engageable portions in the platform when engaging the first fork and second fork engaging means.

The pallet of the present invention allows of its use with a pallet truck having forks which extend during the engaging operation beyond the edges of the platform of the pallet. Such a situation arises when the maximum distance between the forks—the inter-fork distance, and/or the individual fork widths is so great, relative to the width of the platform as defined, that overlap of the respective fork with any adjacent pallet occurs.

In consequence of the pallets having their platforms above the fork engaging members and being provided with non-fork engaging portions this provides spaces below the platform at a pair of its parallel edges. The forks can enter the pallet beneath the platform, raise the pallet off the ground to a sufficient pallet transportable degree, without the overlapping portion of the fork engaging any adjacent pallet platform. This is because the overlapping portion of each fork is received by the adjacent space of a similar adjacent pallet.

Thus, the essence of the present invention is that the fork engaging members of the pallets do not extend to those platform edges parallel to the fork entry direction.

Each of the fork engaging members, together with the platform in a first pallet, partially define a space which becomes, in an adjacent pallet operably, partially or wholly, occupied by a portion of a fork when the fork is raising the first pallet.

In a more preferred embodiment the invention provides a pallet as hereinbefore defined wherein said platform is formed of a plurality of rectangular platform members; said first fork engaging means and said second fork engaging means comprise an integrally formed rectangular fork engaging member disposed below and abutted to said platform, and adjacent to but distant from said first and said second edges to provide said platform adjacent said first and said second edges with said first and said second fork non-engageable portions;

said support means comprises a first rectangular support member and a second rectangular support member disposed parallel to, but distant from, said first and second platform edges, and wherein each of said first and second rectangular support members with said base, said first and second rectangular fork engaging members and said first and second fork non-engageable portions define a first open-ended fork entry aperture and a second open-ended fork entry aperture, respectively.

The ability for an "oversized" pallet truck to be used to selectively lift a pallet from a plurality of adjacent, intimately abutting loaded pallets is of significant valve in allowing maximum use of floor space—by not leaving gaps between adjacent loaded pallets, or by not requiring said pallets to be individually loaded or unloaded when in series with intimately abutting adjacent pallets. Thus, this invention advantageously allows pallets to be loaded with goods at a site remote from the shop floor space to be eventually occupied.

Thus the pallet according to the invention allows of its use with a pallet truck having forks which are, either, overly spaced apart, or of such an individual width, relative to the width of the pallet, such that the forks extend beyond the edges of the load carrying platform. This can be achieved with pallets of at least a narrower width, if not smaller in both length and width than presently in general use.

Heretobefore such a predicament has resulted either in adjacent pallets being placed a distance from each other to leave an inconvenient and costly gap, or the containers being individually unloaded from the pallet, or in requiring use of larger sized pallets adapted to receive the forks under and wholly within the platform width.

Thus, the invention provides pallets which may be intimately abutted against each other, may be of a smaller size than are generally used and, thus, may accommodate irregular sized containers which fully utilize the platform area, and which are removable from the middle of a pallet series without disturbance of the neighbouring pallets. These features provide significant economic advantages in dispensing with the need for manual unloading of individual containers and for maximum advertising space and shop floor utilization.

Accordingly, the invention provides in a further aspect a pallet assembly comprising a pallet as hereinbefore defined and a plurality of containers stacked thereupon.

In yet a further feature, the invention provides a series of pallet assemblies comprising a plurality of pallets as hereinbefore defined wherein each of said pallets has a plurality of containers stacked thereupon, wherein said pallets are disposed in said series in adjacent intimate abutting relationship one against another; and wherein each of said pallets may be operably individually raised and transported by a pallet truck having a pair of forks of an inter-fork distance greater than said platform width.

BRIEF DESCRIPTION OF THE DRAWINGS

In order that the invention may be better understood a preferred embodiment will now be described by way of example only with reference to the accompanying drawings wherein.

DETAILED DESCRIPTION OF THE DRAWINGS

The pallet generally has a front, a back and two sides, each of which sides have longitudinal openings along the length of the side and open at both front and back ends to provide fork entry openings. Each of the openings has a stepped upper surface which takes the form of a horizontal lower portion operably engageable with a fork of a pallet truck, and an upper horizontal outer portion extending from the inner portion to the side and spaced upwardly from the inner portion which is not operably engageable with the fork.

Figure 1:
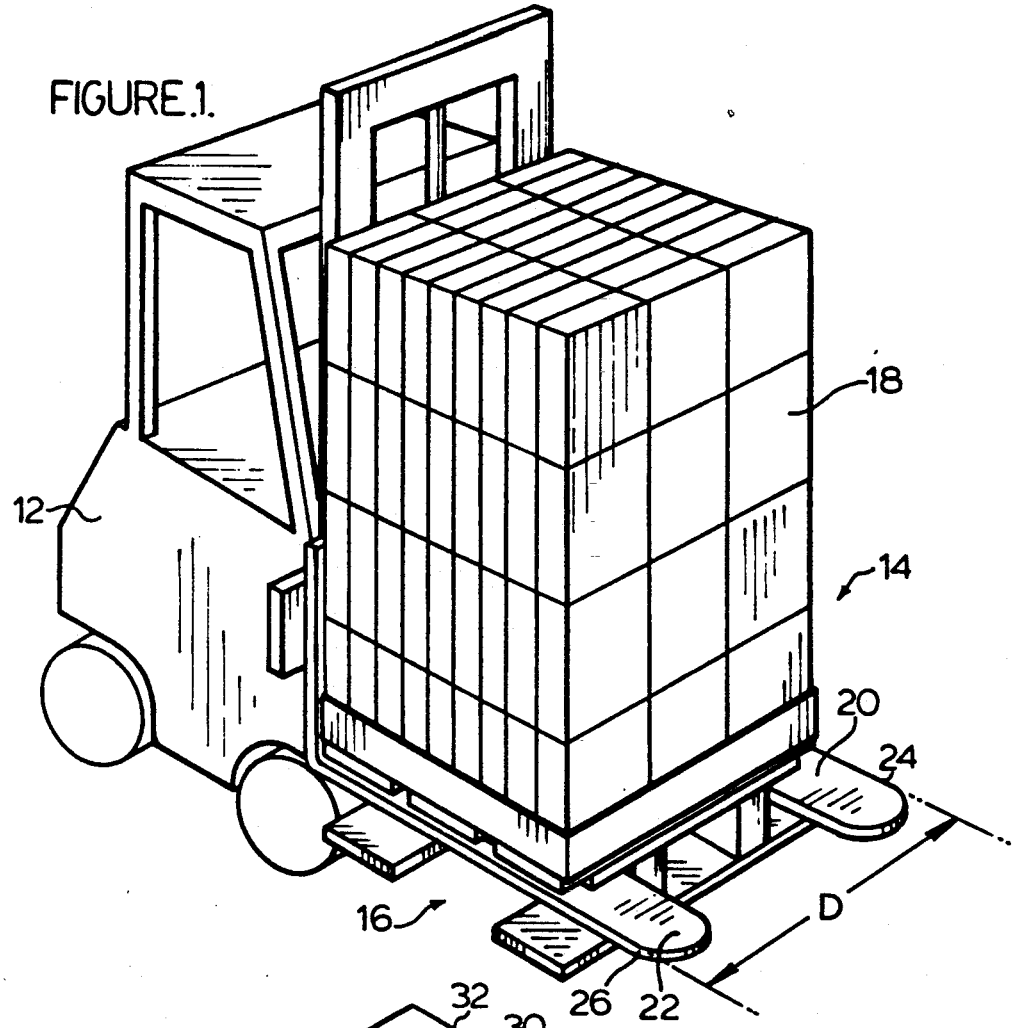
FIG. 1 is a perspective view of a pallet assembly according to the invention retained on a pallet truck.

With particular reference to FIG. 1, this shows, generally, a pallet truck 12, retaining a pallet assembly 14 consisting of a pallet shown generally as 16 and a plurality of containers 18.

Pallet truck 12 has a pair of parallel forks 20, 22 separated by a inter-fork distance D, extending from the outer edge 24 of fork 20 to the outer edge 26 of fork 22.

Figure 2:
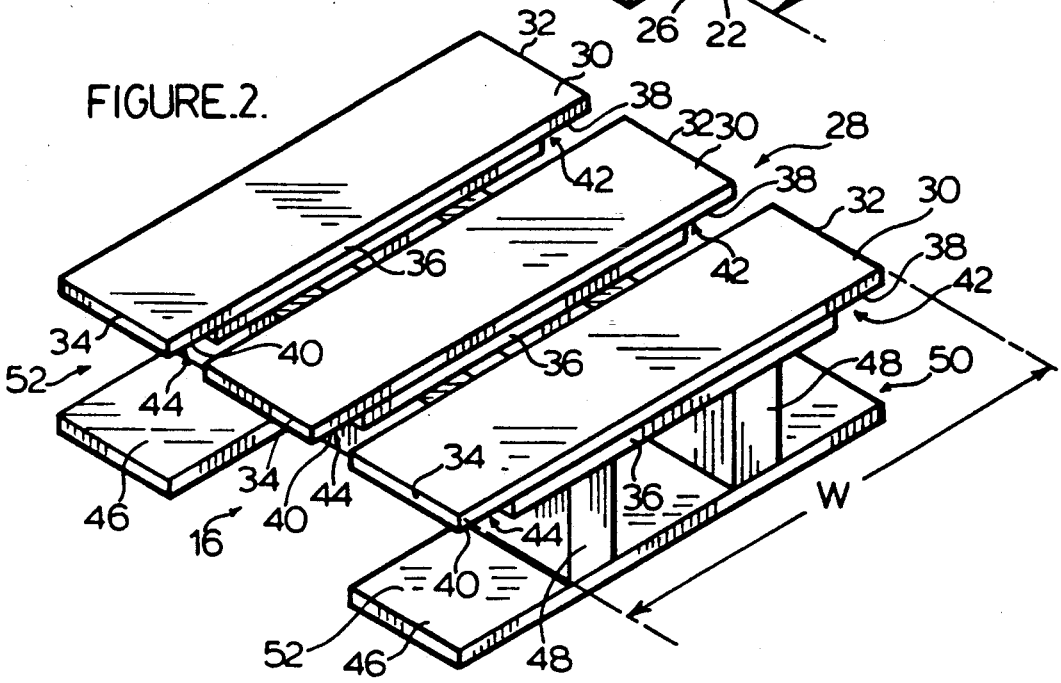
FIG. 2 is a perspective view of a pallet according to the invention.
Figure 3:
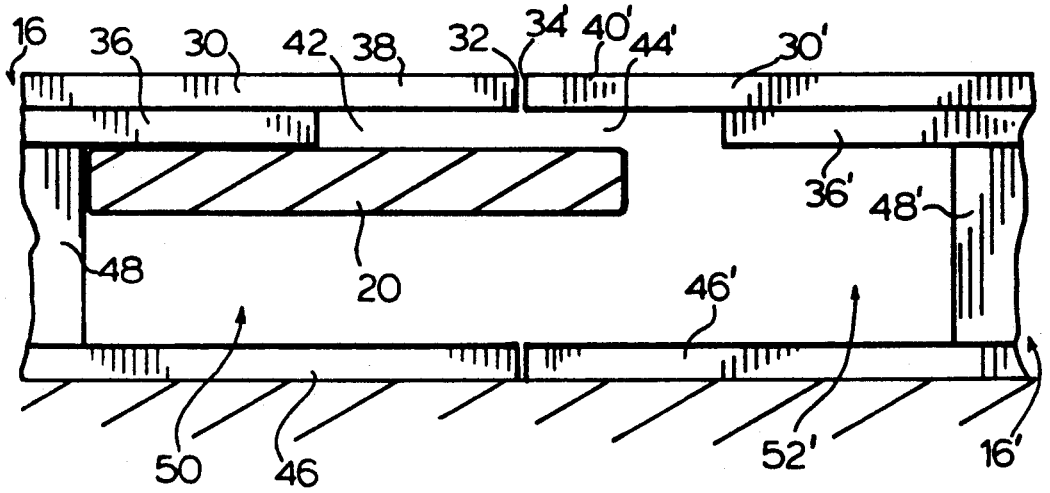
FIG. 3 shows a diagrammatic front view, in part, of a pair of adjacent pallets according to the invention and a section of a fork of a pallet truck, with the pallets in a lowered portion.
Figure 4:
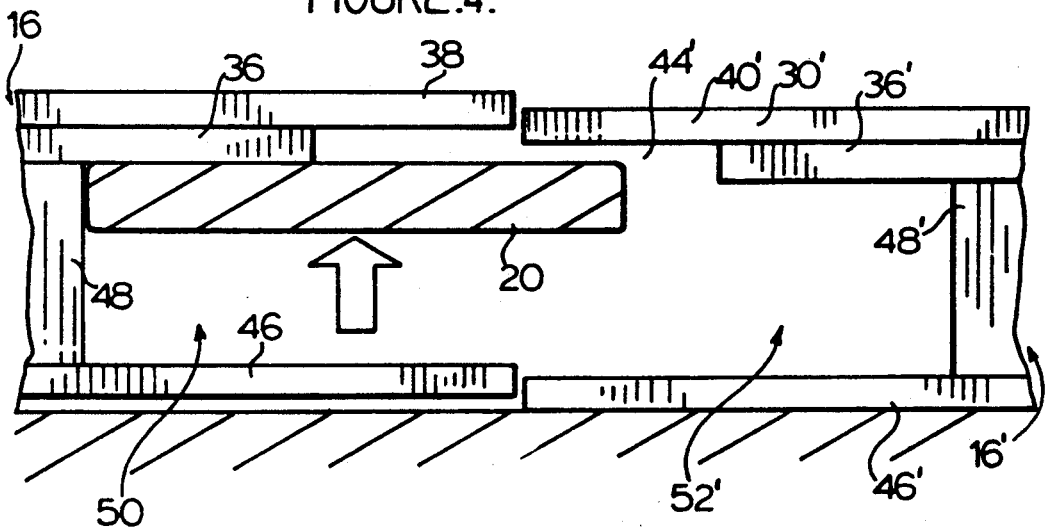
FIG. 4 is as for FIG. 3 wherein one pallet is in a raised position.

With particular reference to FIGS. 2, 3 and 4 pallet 16 comprises a platform shown generally as 28 having a width W of 0.55 m and a depth of 0.72 m. Platform 28 is constituted by a plurality of rectangular platform members 30, which terminate in a platform first edge 32 and a second platform edge 34 parallel thereto and separated by platform width W.

Disposed below each of platform members 30 is a rectangular fork engaging member 36 constituting an integrally formed first and second fork engaging member. Members 36 abuts platform members 30,but terminate adjacent to, but distant from, first edge 32 and second edge 34 to provide fork non-engageable platform portions 38 and 40, respectively, and corresponding spaces, thereunder 42 and 44, respectively.

Pallet 16 has a pair of rectangular base members 46, constituting a base, and a pair of parallel support members 48 disposed inwardly of platform members 30.

Support members 48 connect base members 46 to platform members 30 through fork engaging members 36, and define, therewith, first and second open-ended fork entry apertures 50 and 52. In the embodiment shown, support members 48 are vertically centered approximately 15 cm from either first edge 32 or second edge 34, and 27 cm from each other.

With particular reference to FIG. 3, numerals having a prime denote corresponding parts of an adjacent pallet 16'. FIG. 3 shows fork 20 disposed within open-ended fork entry aperture 50 and partly within adjacent open-ended fork entry aperture 52'; while in operable engagement with rectangular fork engaging member 36. Fork 20 does not operably engage either of fork non-engaging platform portions 38, 40'.

With particular reference to FIG. 4, the broad arrow denotes that pallet 16 has been raised by fork 20 engaging fork engaging member 36. Fork 20 has entered space 44' but has not engaged or contacted fork non-engaging platform portion 40'.

Figure 5:
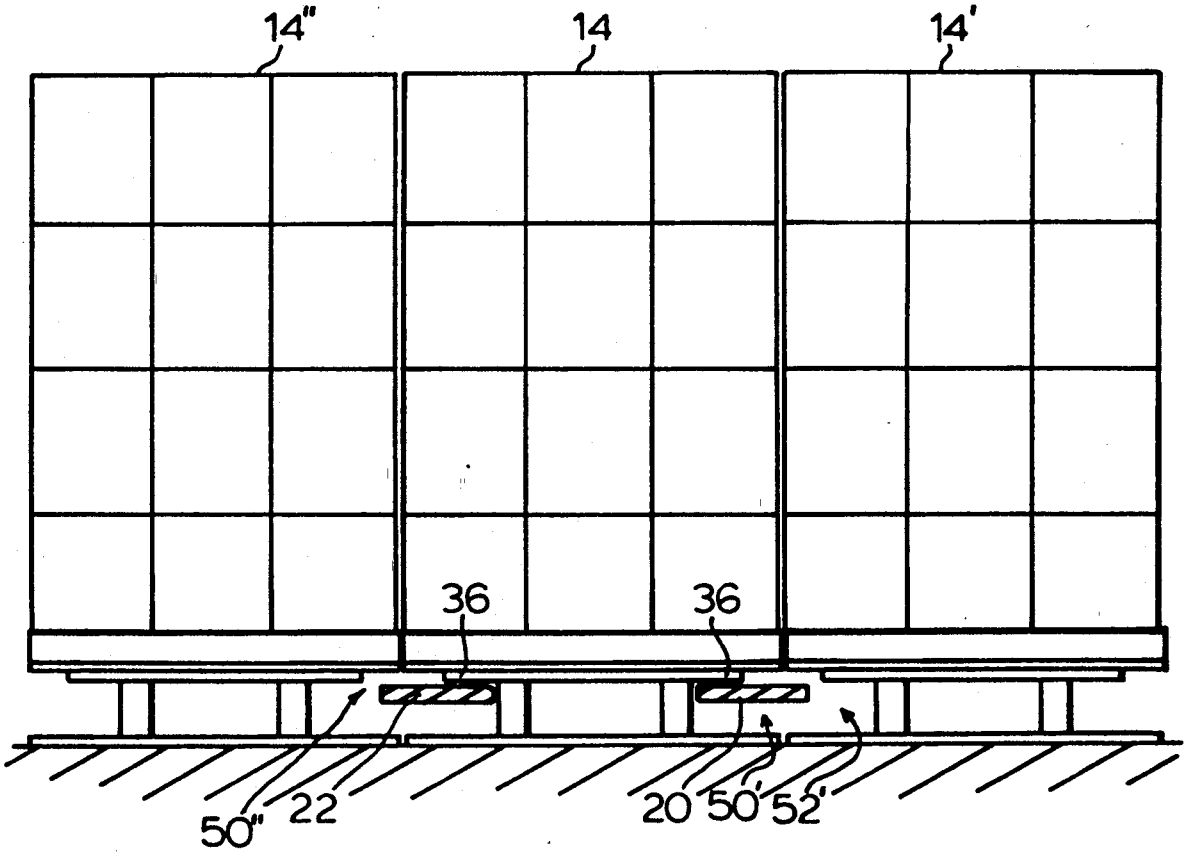
FIG. 5 is a diagrammatic view of a plurality of pallet assemblies according to the invention.

FIG. 5 shows three pallet assemblies 14, 14' and 14" in adjacent intimate abutting relationship. Forks 20, 22 of a pallet truck engage fork engaging members 36 of centre pallet assembly 14 while overlapping into both adjacent pallet assemblies 14', 14" within adjacent open-ended fork entry apertures 52', 50".

In operation, with particular reference to FIG. 5, to move pallet assembly 14, truck 12 approaches pallet assembly 14 such that forks 20, 22 enter open-ended fork entry apertures 50, 52, respectively, below fork engaging members 36. Forks 20, 22 overlap into adjacent open-ended fork entry apertures 52', 50", respectively. Raising of forks 20, 22 to effect contact with fork engaging members 36 and raising of pallet assembly 14 approximately 2–3 cm., being a height less than the thickness of fork engaging members 36, off the ground permits removal of pallet assembly 14 from the series of pallet assemblies, as shown in FIG. 5, by reversal of pallet truck 12.

A pallet truck 12 reverse operation allows a new pallet assembly to be intimately inserted and disposed between pallet assemblies 14" and 14'.

It will be understood that the dimensions of fork engaging members 36 and fork non-engageable platform portions 38, 40 for use in a platform having a width W will be determined and selected relative to the inter-fork distance D and the width of the individual forks. However, provided that when inter-fork distance D is greater than platform width W, that there is a sufficient distance between the end of the fork engaging member and the corresponding adjacent fork engaging member of an adjacent pallet such that the fork only engages the single fork engaging member, then the fork overlap into adjacent pallet assemblies does not present disruption of the adjacent pallet assemblies.

It can be seen that the invention is of most beneficial value when pallets of a smaller size than conventional pallets are desired but with only standard pallet trucks being available.

Although this disclosure has described and illustrated a certain preferred embodiment of the invention, it is to be understood that the invention is not restricted to this particular embodiment. Rather, the invention includes all embodiments which are functional or mechanical equivalents of the specific embodiments and features that have been described and illustrated.

The embodiments of the invention in which an exclusive property or privilege is claimed are defined as follows:

1. A pallet for use with a plurality of containers to be stacked thereupon and operably raisable, transportable and lowerable by a pallet truck having a first fork and a second fork separated by an inter-fork distance said distance being the distance between the outer lengthwise edges of said first and said second forks; said pallet comprising:

a platform upon which said containers are stacked, said platform having a first edge and a second edge parallel to said first edge and wherein said first edge is separated by a platform width from said second edge;

a first fork engaging member below said platform adjacent to, but distant from, said first edge and operably engageable with said first fork;

a second fork engaging member below said platform adjacent to, but distant from, said second edge and operably engageable with said second fork;

a base having a width the same as said platform width; and wherein said inter-fork distance is greater than said platform width; such that a portion of said forks operably extend beyond said first and said second edges of said platform and wherein said forks do not operably engaged said platform.

2. A pallet as claimed in claim 1 wherein said first engaging member is integrally formed with said second engaging member.

3. A pallet as claimed in claim 1 formed of wood, aluminum or a rigid plastic material.

4. A series of pallet assemblies comprising a plurality of pallets as claimed in claim 1 stacked thereupon and a plurality of containers wherein each of said pallets has a plurality of containers stacked thereupon, wherein said pallets are disposed in said series in adjacent intimate abutting relationship one against another; and wherein each of said pallets may be operably individually raised and transported by a pallet truck having a pair of forks of an inter-fork distance greater than said platform width.

5. A pallet comprising:

a rectangular platform having a first edge and a second edge parallel to said first edge and wherein said first edge is separated by a platform width from said second edge;

a fork engaging member disposed below and abutted to said platform and adjacent to but distant from said first and said second edges to provide said platform adjacent said first edge and said second edge with a first and a second fork non-engageable portions, respectively;

a rectangular base having a width the same as said platform width; and a first rectangular support member and a second rectangular support member disposed between said platform and said base and parallel to but distant from said first and said second platform edges, wherein said base and said fork engaging member with said first rectangular support member and said first fork non-engageable portion define a first open-ended fork entry aperture and wherein said base and said fork engaging member with said second rectangular support member and said second fork non-engageable portion define a second open-ended fork entry aperture.

6. A pallet for use in storing thereon a plurality of containers, and operably raisable, transportable and lowerable by a pallet truck having a first fork and a second fork; said pallet comprising:

a rectangular platform having a first edge and a second edge parallel to said first edge wherein said first edge is separated by a platform width from said second edge;

a first fork engaging member operably engageable with said first fork and disposed below and abutted to said platform, and adjacent to but distant from said first edge to provide said platform adjacent said first edge with a first fork non-engageable portion such that when said first fork is operably engaged with said first fork engaging member said first fork non-engageable portion does not engage said first fork;

a second fork engaging member operably engageable with said second fork and disposed below and abutted to said platform, and adjacent to but distant from said second edge to provide said platform adjacent said second edge with a second fork non-engageable portion such that when said second fork is operably engaged with said second fork engaging member said second fork non-engageable portion does not engage said second fork;

a rectangular base having a width the same as said platform width; and means for supporting said platform on said base disposed between said platform and said base.

* * * * *